United States Patent [19]

Sides

[11] Patent Number: 5,034,100

[45] Date of Patent: Jul. 23, 1991

[54] STATIONARY DRAINAGE DEVICE WITH PRESSURE ROLL

[75] Inventor: Geoff T. Sides, Shrewsbury, United Kingdom

[73] Assignee: Wilbanks International, Hillsboro, Oreg.

[21] Appl. No.: 619,191

[22] Filed: Nov. 28, 1990

[51] Int. Cl.[5] ..... D21F 2/00; D21F 1/48

[52] U.S. Cl. ..... 162/306; 162/358; 162/363; 162/374

[58] Field of Search ..... 162/305, 306, 307, 358, 162/374, 363; 100/153, 154, 121

[56] References Cited

U.S. PATENT DOCUMENTS

| | | | |
|---|---|---|---|
| 2,543,870 | 3/1951 | Robbins | 162/374 |
| 3,556,936 | 1/1971 | Miyamoto | 162/306 |
| 3,824,152 | 7/1974 | Nevalainen | 162/301 |
| 4,270,978 | 6/1981 | Fioravanti | 162/199 |
| 4,406,739 | 9/1983 | Kankaanpaa | 162/306 |
| 4,443,300 | 4/1984 | Bubik et al. | 162/306 |
| 4,880,500 | 11/1989 | Eldridge et al. | 162/279 |
| 4,919,760 | 4/1990 | Kerttula | 162/300 |

*Primary Examiner*—Karen M. Hastings

*Attorney, Agent, or Firm*—Klarquist, Sparkman, Campbell, Leigh & Whinston

[57] ABSTRACT

A stationary drainage device for a papermaking machine is described including a drainage box which may have a plurality of vacuum chambers and a stationary curved cover formed by cover strips of ceramic material separated by drainage slots. The cover includes a central cover strip of greater width than the other cover strips on opposite sides thereof. A pressure roll presses the paper sheet and the porous conveyor transporting such sheet across the curved cover of the drainage device, against the curved upper surface of the central cover strip at a nip position spaced from the drainage slots and the other cover strips for greater dewatering efficiency. The stationary drainage device may be mounted at the output of the forming section as a stationary couch device or in the press section as a felt conveyor cleaning and dewatering device.

20 Claims, 2 Drawing Sheets

STATIONARY DRAINAGE DEVICE WITH PRESSURE ROLL

BACKGROUND OF INVENTION

The subject matter of the present invention relates generally to drainage apparatus for a papermaking machine and in particular to a stationary drainage device including a drainage box closed by a stationary curved cover formed by cover elements of ceramic material and including a central cover element of greater width in the direction of travel of the paper sheet than the other cover elements on opposite sides thereof and a pressure roll which presses the paper sheet and the conveyor for such sheet against the upper surface of the central cover element.

It has previously been the practice in papermaking machines to provide a suction couch roll at the output of the forming section of the papermaking machine adjacent the porous conveyor "wire" on which the paper sheet is formed by draining water from the paper pulp stock through the conveyor. The suction couch roll is mounted at a position downstream from where the paper pulp stock is formed into a self-supporting paper sheet at a position immediately upstream from where the paper sheet is transferred from the conveyor wire to the press section of the machine onto a felt conveyor in such press section. The suction couch roll rotates and contains one or more stationary suction boxes within the roll requiring vacuum seals between the suction boxes and the inner surface of the shell of the couch roll. Also, the porous conveyor carrying the paper sheet contacts only a small portion of the couch roll in an arc of less than about 60 degrees. This reduces the effective surface area of the couch roll available for suctioning the water from the paper sheet to less than 20 percent. In addition, the couch roll is a complicated and expensive apparatus which is difficult to maintain because the seals must frequently be replaced requiring removal of the roll for maintenance. Because of this it has been proposed in U.S. Pat. No. 4,880,500 of Eldridge issued Nov. 14, 1989 to provide a stationary couch device with a curved cover in place of a rotating suction couch roll. However, this stationary couch device has several disadvantages since it is made of thick self-supported segments of ceramic material which are drilled to provide circular holes or elongated slots in such cover segments for drainage. These drilled holes or slots are subject to clogging which reduces dewatering efficiency and requires special cleaning spray channels to be provided in the ceramic cover segments making the couch device extremely expensive and somewhat impractical.

It has previously been proposed to provide a pressure roll above the rotating suction couch roll in order to press the conveyor wire and paper sheet between the press roll and the couch roll for more uniform distribution of water and to break lumps in the paper sheet. Another use of press rolls is shown in U.S. Pat. No. 3,824,152 of Nevalainen issued July 16, 1974 on a twin-wire papermaking machine with a rotating suction cylinder having a conveyor wire and a conveyor felt wrapped about such cylinder. The suction cylinder contains several zones of different pressure including a pressing zone above which the pressure rolls are provided for a more effective water removal from the paper sheet and the conveyor felt. However, this patent does not show the use of a stationary suction couch device much less such a stationary couch device including a curved cover formed by ceramic cover strips separated by drainage slots or the use of a central cover strip of greater width which is engaged by a pressure roll pressing the paper sheet and conveyor together against the upper surface of such central cover strip at a position spaced from the drainage slots in the manner of the present invention.

U.S. Pat. No. 4,919,760 of Kerttula issued Apr. 24, 1990 shows another type of twin-wire papermaking machine including a forming shoe with a curved upper surface across which the conveyor wire is moved in order to form the pulp stock into a self-supporting sheet of paper which is then transmitted past flat suction boxes and a couch roll for greater water removal. However, there is no disclosure of a stationary couch device mounted on the papermaking machine at a position on the conveyor normally occupied by the rotating couch roll and employing a press roll in engagement with an enlarged central section of the curved cover of the stationary couch device in the manner of the present invention.

It has also been proposed to provide a stationary curved drainage device for dewatering the conveyor felt in the press section of the papermaking machine, as shown in U.S. Pat. No. 4,270,978 of Fioravanti issued June 2, 1981. However, there is no suggestion of using a pressure roll to urge the felt against the stationary curved drainage device for greater cleaning and dewatering efficiency in the manner of the present invention. It is conventional to provide a stationary flat suction box in the forming section of the papermaking machine for engagement with the conveyor wire as shown in U.S. Pat. No. 2,543,870 of Robbins, issued Mar. 6, 1951. However, there is no suggestion of employing a press roll to press the paper sheet and conveyor wire against the flat cover of such stationary suction box device.

The use of a pressure roll to press the conveyor wire and paper sheet against the perforated surface of a moving suction couch roll at high pressures on the order of approximately 200 pounds per lineal inch of pressure roll length, causes problems because the paper sheet protrudes through the openings in the couch roll causing uneven moisture distribution in the paper sheets and may result in hole patterns produced on the surface of the paper sheet and weakening of the sheet. This problem is avoided when the couch roll is a non-suction unperforated couch roll with no suction openings in its cover. However, even with an unperforated couch roll there is a problem due to water backup in front of the nip of the pressure roll where it presses the paper sheet and conveyor wire against the couch roll. In addition, water is thrown off the couch roll after the nip which can also produce an uneven moisture distribution in the paper sheet. These two problems are overcome by the stationary couch device of the present invention which employs a central unperforated cover strip of greater width than the other cover strips, which is engaged by the pressure roll. As a result there is no pushing of the paper sheet through the drainage slots between the ceramic strips on opposite sides of such central strip, and the water backup and water throw off conditions are eliminated by the dewatering of the nip due to the pressure within the stationary suction couch device.

The use of a pressure roll with slotted stationary suction box with cover strips of the same width and separated by drainage slots cause even greater nonuniform moisture distribution and marking of the paper sheet than the suction couch roll due to pressure of the pressure roll pushing the paper sheet and the conveyor wire into the slots. This would tend to cause higher loads on the drive mechanism for the conveyor wire, possibly damaging the conveyor wire. These problems are avoided in the present invention by using a central cover strip of greater width which is unperforated and contacting such central strip with the pressure roll without contacting the drainage slots on opposite sides thereof or the remaining narrow ceramic cover strips.

In addition to overcoming these problems, the present invention has the added advantage of providing the ability to run a lightly nipped pressure roll on a curved stationary couch cover of ceramic material thereby producing a compacted paper sheet having fewer fibrous lumps in the paper sheet. In addition, there is reduced moisture content as well as more uniform moisture distribution in the paper due to the use of a slotted cover for the stationary couch device of the present invention which removes water with greater efficiency than a suction couch roll. Also, there is no water backup in front of the nip or water throw off behind the nip, which tends to disturb the paper sheet.

SUMMARY OF INVENTION

It is therefore one object of the present invention to provide an improved dewatering apparatus for a papermaking machine including a stationary drainage device with a curved stationary cover having dewatering openings therethrough formed by spaced cover elements of ceramic material and an unperforated central cover element which is of greater width than the other cover elements on opposite sides thereof and a pressure roll which presses the paper sheet and the conveyor moving such sheet against the upper surface of the central cover element for greater dewatering efficiency.

Another object of the invention is to provide such a dewatering apparatus of simple and economic construction in which the position of the pressure roll nip is spaced from the other cover elements for producing a paper sheet of lower moisture content and of more uniform moisture distribution.

A further object of the invention is to provide such a stationary drainage device in which the paper sheet is not pressed through openings in the cover of the drainage device by the press roll to provide a paper sheet of more uniform moisture content and less fibrous lumps.

An additional object of the invention is to provide such a stationary drainage device including a suction box with one or more vacuum chambers therein which avoids paper sheet disturbance due to water backup in front of the nip and water throw off behind the nip.

Still another object of the invention is to provide such an improved stationary drainage device in which the curved stationary cover includes cover strips of ceramic material which are spaced apart by drainage slots for more efficient dewatering.

A still further object of the invention is to provide a stationary couch device of such construction mounted at the output of the forming section to replace a conventional suction couch roll for greater dewatering efficiency to produce a paper sheet of lower moisture content and more even moisture distribution.

DESCRIPTION OF DRAWINGS

Other objects and advantages of the present invention will be apparent from the following detailed description of a preferred embodiment thereof and from the attached drawings of which.

DESCRIPTION OF PREFERRED EMBODIMENT

Figure 1:
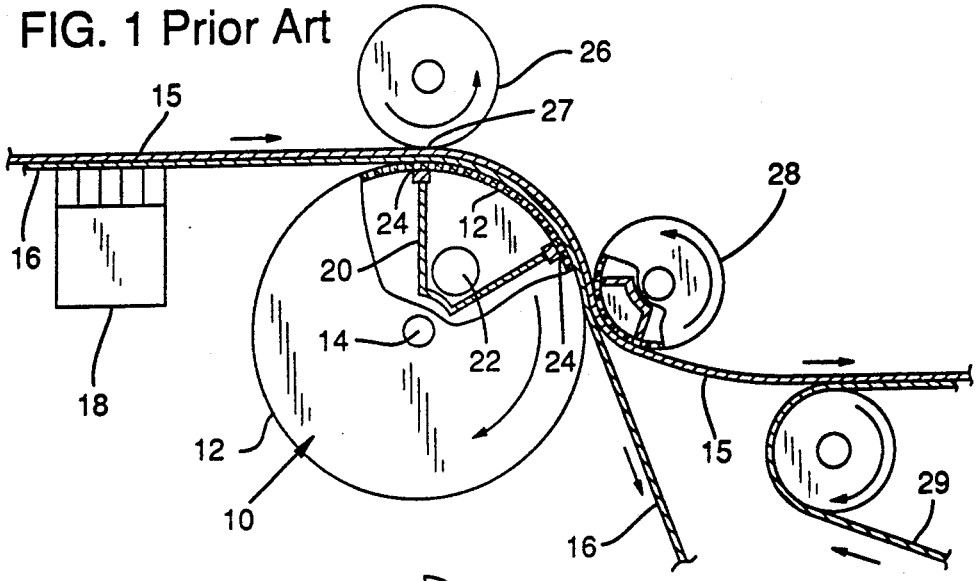
FIG. 1 Prior Art
FIG. 1 is a side section view of a prior art drainage device using a rotating suction couch roll and pressure roll.

A drainage apparatus for a papermaking machine including a stationary drainage device with pressure roll in accordance with the present invention is shown in FIGS. 2 to 5. However, before considering this invention it will be helpful to review the prior art suction couch roll apparatus shown in FIG. 1. In FIG. 1 a portion of the forming section of a papermaking machine is shown including a rotating suction couch roll 10 which has a perforated cylindrical outer shell 12 of metal, such as stainless steel, having a plurality of dewatering openings therethrough which are normally drilled holes of circular shape. The cylindrical shell rotates about an axis 14, a paper sheet 15 formed from a paper stock solution of wood pulp and water is carried by a porous conveyor "wire" 16 over the suction couch roll 10 for additional dewatering of such sheet. Such couch roll may be connected to a drive motor to provide additional drive means for the conveyor wire 16 on which the paper sheet is carried. The porous conveyor "wire" 16 is made of either metal wire screen or synthetic plastic fabric. After the paper sheet is formed, it is carried by the conveyor wire 16 across several dewatering elements including flat suction boxes 18 and the suction couch roll 10 at the output end of the forming section for additional water removal from the paper sheet. The suction couch roll includes a stationary vacuum suction box 20 containing a vacuum chamber connected to a vacuum source through drainage outlets 22 at the opposite ends of such box. The outer edges of the vacuum box 20 are sealed to the inner surface of the rotating shell 12 by two rubber seals 24 at the leading and trailing edges of such box. It should be noted that the vacuum box covers only a small portion of the shell 12 of the suction couch roll and typically extends through an arc of less than 60 degrees on such roll.

The conveyor wire 16 engages and wraps around the suction couch roll in an arcuate surface portion of the shell 12 above the vacuum box 20. As a result, the effective dewatering area of the suction couch roll is only approximately 20 percent of the total area of the suction couch roll. In order to improve the quality of the paper sheet, it has been proposed to provide a pressure roll 26 sometimes called a "lump breaker" roll, above the suction couch roll to press the paper sheet and the conveyor wire 16 at a nip 27 between the pressure roll and the suction couch roll. While the pressure roll 26 does remove lumps in the paper sheet, it tends to disturb the surface of the paper sheet by pushing such paper sheet into the openings of the suction couch roll. This produces an uneven moisture distribution in the paper sheet and may produce an undesirable hole pattern on the surface of the paper or otherwise disturb such surface which is undesirable. In addition, it has been proposed to employ such lump breaker roll on a non-perforated couch roll which does not contain a vacuum box, in order to overcome this problem. However, this unperforated couch roll and press roll combination creates additional problems due to the water backup in front of the nip between the pressure roll and the couch roll and also by water spray from the rolls rearward of the nip which undesirably effects the surface of the paper, causes nonuniform moisture distribution and may reduce its strength. These problems are all overcome by the drainage apparatus of the present invention shown in FIGS. 2 to 5.

The paper sheet 15 is removed from the conveyor wire 16 by a suction transfer roll 28 and transferred from the forming section onto a conveyor felt 29 at the input of the press section (not shown) of the papermaking machine for further dewatering. It should be noted that the stationary drainage device with pressure roll of the present invention as hereafter described, may also be employed in such press section to remove water from the conveyor felt which conveys the paper sheet through such press section.

As shown in FIGS. 2 to 5, the stationary drainage device of the present invention may be a stationary suction couch device 30 including a suction couch box 31 having at least one vacuum chamber. Preferably the suction box contains several vacuum chambers of different pressure in the range of 10 to 20 inches of mercury, including a first vacuum chamber 32 connected to a first vacuum pump 34 at outlet 36 and a second vacuum chamber 38 connected to a second vacuum pump 40 at outlet 42 of the second chamber. As a result, the second vacuum chamber 38 may be provided with a second vacuum pressure, V2, of a greater pressure than the first vacuum pressure, V1, of the first vacuum chamber 32 for additional dewatering of the paper sheet by the second chamber. The first and second vacuum chambers are separated by a divider partition including a first partition wall 44 and a second partition wall 46 which are welded to the bottom of the suction box 31 and are joined at the top by a stainless steel bar member 48 extending together across the full width of the suction couch device in a direction perpendicular to the direction of travel of the porous conveyor wire 16 and paper sheet 15 carried thereon.

Figure 5:
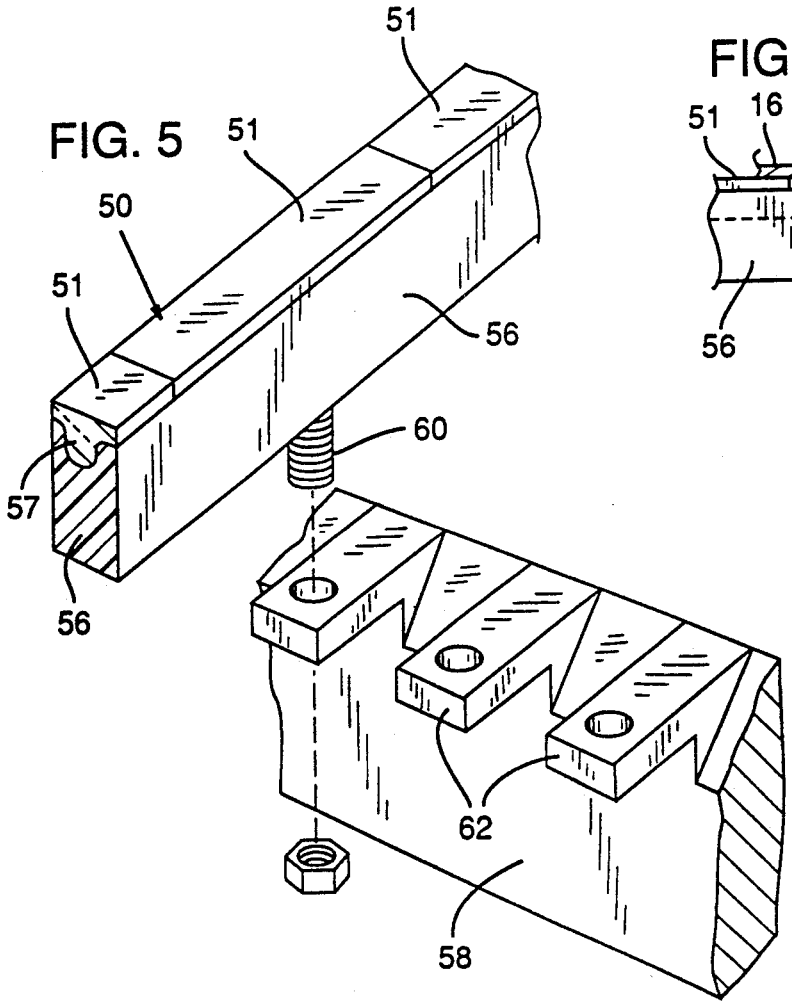
FIG. 5 is an enlarged exploded view of a portion of the cover strip mounting of FIGS. 2 and 3.
Figure 3:
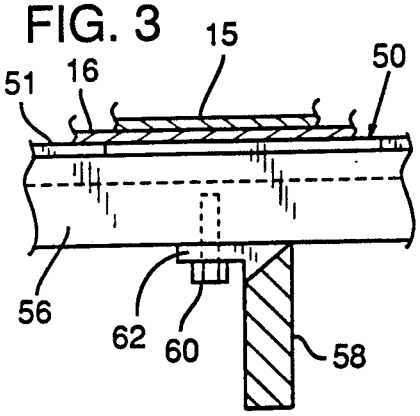
FIG. 3 is an enlarged section of view taken along the line 3—3 of FIG. 2.

The suction couch device 30 is provided with a convexly curved cover formed by a plurality of elongated narrow cover strips 50 of ceramic material which extend along the length of the couch box 31 and are separated by drainage slots 52 between such cover strips. The cover strips are uniformly spaced apart and of substantially the same narrow width across the width of the box in the direction of travel of the conveyor belt except for a central cover strip 54 which is of much greater width than the other cover strips 50 on opposite sides thereof and is typically over six times the width of such other cover strips. The narrow cover strips 50 and the central cover strip 54 may be made of a wear resistant ceramic material such as aluminum oxide or zirconium oxide ceramic. Each of the cover strips 50 is made of a plurality of ceramic segments 51 about ⅝ inch wide which are mounted on a common support member 56 of fiberglass reinforced plastic material, such as vinyl ester, by tongue portions 57 held in mating mounting grooves in such support members with a suitable adhesive such as epoxy resin as shown in FIG. 5. The fiberglass support members 56 supporting the ceramic cover strips 50 are attached to stainless steel cross braces 58 extending substantially parallel and longitudinally of the direction of travel of the conveyor belt 16 and spaced approximately eight inches apart along the length of the suction box 31. The fiberglass support members 56 are attached to the cross braces 58 by means of bolts 60 which are bonded in threaded holes in the support members and extend through holes in mounting arms 62 projecting outwardly from the sides of cross braces 58 as shown in FIGS. 3 and 5.

The ceramic segments of the central cover strip 54 are mounted by dovetail tongue and groove connections including a dovetail projection 64 on top of a fiber reinforced plastic support member 66 which is preferably made of fiberglass reinforced vinyl ester plastic. The central cover strip segments are about ¾ inch wide and each have a convexly curved top surface 67 and a dovetail groove 68 in the bottom surface thereof which mates with the dovetail projection 64. The groove 68 contains a bonding adhesive such as epoxy resin, which bonds the ceramic cover strip segments to the support member 66. Such support member extends across the entire width of the conveyor belt 16 and may be supported on the top of the upper bar 48 of the vacuum box divider. The opposite ends of the cross braces 58 are fastened by bolts 69 to this support member 66 and to the sides of the cover which may be formed by specially molded fiberglass reinforced plastic support members for the leading and trailing edge cover strips. The cover is mounted on the opposite sides 70 the suction box 31 by a removable clam plate 71 which is bolted to the rear edge of the top of the suction box.

Figure 2:
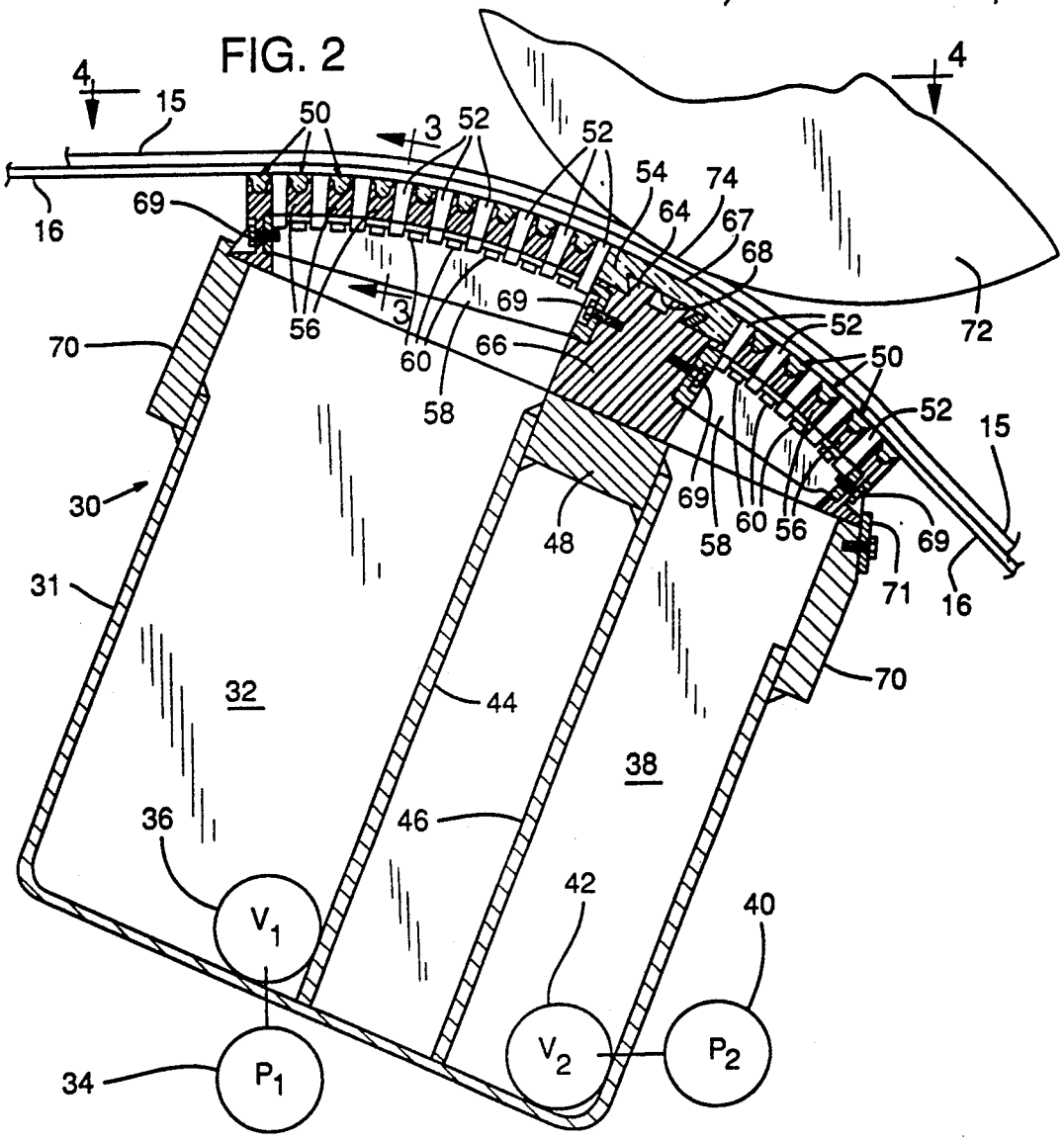
FIG. 2 is a side section view of a preferred embodiment of the present invention showing a stationary curved drainage device and pressure roll.
Figure 4:
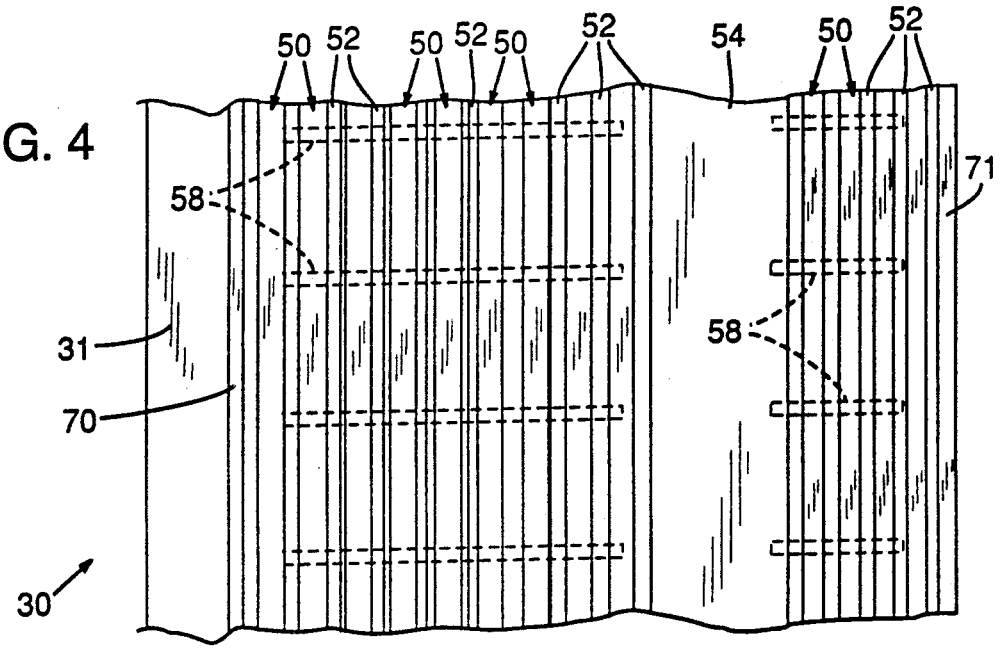
FIG. 4 is a plan view of the curved stationary couch device of FIG. 2 with a portion of the pressure roll broken away for purposes of clarity.

As shown in FIG. 2, a pressure roll 72 which may have a resilient outer surface provided by a cover of rubber or other elastomer material presses the paper sheet 15 and conveyor wire 16 against the top 67 of the central cover strip 54 at a nip position 74 spaced from the drainage slots 52 and the narrow cover strips on opposite sides of such central cover strip. This increases the dewatering of the paper sheet by the stationary couch device 30 without causing non-uniform moisture distribution in such paper sheet or producing a hole pattern on the sheet. In addition to greater dewatering efficiency, any water build up in front of the nip of the press roll water spray following the nip are eliminated by the suction of the vacuum chambers 32 and 38 in the stationary couch device of the present invention. The result is a high quality surface finish paper sheet of lower moisture content and more uniform moisture distribution.

It will be obvious to those having ordinary skill in the art that many changes may be made in the preferred embodiment of the invention shown in the drawings. Therefore the scope of the invention should be determined by the following claims.

I claim:

1. Drainage apparatus for a papermaking machine, comprising:

a stationary drainage device including a drainage box covered by a stationary curved cover with drainage openings, said cover being formed by elongated cover elements of ceramic material having greater lengths than widths so that when mounted in the papermaking machine said cover elements have upper surfaces extending across a porous conveyer having a direction of travel which conveys a paper sheet in the papermaking machine;

said cover elements including a central cover element of greater width in the direction of travel of the conveyor than the width of the other cover elements on opposite sides of said central cover element; and a pressure roll located opposite said central cover element so that said pressure roll presses the paper sheet and the conveyor together against the upper surface of said central cover element but not against the other cover elements.

2. Drainage apparatus in accordance with claim 1 in which the drainage box is a suction box having at least one vacuum chamber therein.

3. Drainage apparatus in accordance with claim 1 in which the drainage box is a suction box having several vacuum chambers of different vacuum pressure including a first chamber forward of the central cover element and a second chamber rearward of said central cover element.

4. Drainage apparatus in accordance with claim 1 in which the cover elements include segmented cover strips of ceramic material separated by drainage slots which extend laterally to the conveyor travel direction.

5. Drainage apparatus in accordance with claim 4 in which the cover elements include support members made of fiberglass reinforced plastic on which the cover strips are supported.

6. Drainage apparatus in accordance with claim 5 in which the support members are mounted on cross braces which extend laterally to the support members.

7. Drainage apparatus in accordance with claim 6 in which the cross braces are of metal and are each provided with mounting projections which are fixed to the support members.

8. Drainage apparatus in accordance with claim 1 which also includes means for mounting the stationary drainage device adjacent an output end of a paper forming section of the papermaking machine in place of a suction couch roll.

9. Drainage apparatus in accordance with claim 1 in which the pressure roll has a resilient outer surface and presses the paper sheet and conveyor against the central cover element at a position spaced from front and rear edges of said central cover element.

10. Drainage apparatus for a papermaking machine, comprising:

a stationary couch device including a suction couch box covered by a stationary curved cover with drainage openings, said cover being formed by elongated cover elements of ceramic material having greater lengths than widths;

Mounting means for mounting said couch device in the papermaking machine so that upper surfaces of the cover elements extend across a porous conveyer having a direction of travel which conveys a paper sheet in the papermaking machine;

said cover elements including a central cover element of greater width in the direction of travel of the conveyor than the width of the other cover elements on opposite sides of said central cover element; and a pressure roll located opposite said central cover element so that said pressure roll presses the paper sheet and the conveyor together against the upper surface of said central cover element but not against the other cover elements.

11. Drainage apparatus in accordance with claim in which the couch box is a suction box having at least one vacuum chamber therein.

12. Drainage apparatus in accordance with claim 10 in which the couch box is a suction box having several vacuum chambers of different vacuum pressure including a first chamber forward of the central cover element and a second chamber rearward of said central cover element.

13. Drainage apparatus in accordance with claim 10 in which the cover elements include segmented cover strips of ceramic material separated by drainage slots which extend laterally to the conveyor travel direction.

14. Drainage apparatus in accordance with claim 13 in which the cover elements include support members made of fiberglass reinforced plastic on which the cover strips are supported.

15. Drainage apparatus in accordance with claim 14 in which the support members are mounted on cross braces which extend laterally to the support members.

16. Drainage apparatus in accordance with claim 15 in which the cross braces are of metal and are each provided with mounting projections which are bolted to the support members.

17. Drainage apparatus in accordance with claim 10 in which the means for mounting the stationary couch device mounts said couch device at a position on the conveyor adjacent a output end of a paper forming section of the papermaking machine after the paper sheet is formed and before it is transferred from the conveyor.

18. Drainage apparatus in accordance with claim 10 in which the pressure roll presses the paper sheet and conveyor against the central cover element at a position spaced from front and rear edges of said central cover element.

19. Drainage apparatus in accordance with claim 10 in which the pressure roll has a resilient outer surface.

20. Drainage apparatus in accordance with claim 19 in which resilient outer surface is of elastomer material.

* * * * *